US005421042A

United States Patent [19]

Hibschman

[11] Patent Number: 5,421,042

[45] Date of Patent: Jun. 6, 1995

[54] PORTABLE OUTDOOR SHOWER DEVICE

[76] Inventor: Steve Hibschman, 4985 Angling Rd., Ludington, Mich. 49431

[21] Appl. No.: 262,522

[22] Filed: Jun. 20, 1994

[51] Int. Cl.[6] ..... A47K 3/22

[52] U.S. Cl. ..... 4/617; 4/602

[58] Field of Search ..... 4/598, 602, 603, 616, 4/617

[56] References Cited

U.S. PATENT DOCUMENTS

| | | | |
|---|---|---|---|
| 192,164 | 6/1877 | Hill | 4/602 |
| 209,372 | 10/1878 | Allen | 4/617 X |
| 774,657 | 11/1904 | Dudley et al. | 4/617 |
| 785,233 | 3/1905 | Simpson | 4/617 |
| 1,011,113 | 12/1911 | Button | 4/617 |

FOREIGN PATENT DOCUMENTS

| | | | |
|---|---|---|---|
| 0813882 | 9/1951 | Germany | 4/617 |
| 0001507 | 4/1926 | United Kingdom | 4/598 |

*Primary Examiner*—Charles E. Phillips
*Attorney, Agent, or Firm*—Douglas S. Bishop

[57] ABSTRACT

A portable outdoor shower device which may be filled initially with water, heated to a desired temperature, from an external heat source, including an open fire, and by means of a suspending mechanism, suspended from a point vertically aligned with the user for shower operations. The device utilizes a single container for heating, moving and suspending the water for shower operations.

16 Claims, 2 Drawing Sheets

PORTABLE OUTDOOR SHOWER DEVICE

BACKGROUND OF THE INVENTION

This invention relates to a portable outdoor shower and, more specifically, to a portable outdoor shower which may be filled initially with water, heated to a desired temperature, and suspended in a desired position for use without having to transfer heated water from one container to another.

The concept of a portable bathing shower suspended from a selected object is known. U.S. Pat. No. 4,151,616, issued to Larson, discloses a combination poncho and camping shower, comprised of water resistent fabric and water dispensing means. U.S. Pat. No. 3,675,251, issued to Ruscher, Jr., discloses a portable shower comprising, in part, a reservoir container, suspended above a showerhead container. U.S. Pat. No. 3,431,565, issued to Nelson, discloses a portable shower in which water is pumped into the shower container through a heat source. U.S. Pat. No. 2,052,420, issued to Peterson, discloses a portable shower bath suspended from a wall bracket, which suspension is adjustable in height. U.S. Pat. No. 1,577,038, issued to Kvitle, discloses a portable shower apparatus having a bucket-type container, having apertures in a spring release device centrally located on the underside of the bucket. U.S. Pat. No. 1,241,764, issued to Pritchett, discloses a suspended portable shower device wherein the primary container is collapsible. U.S. Pat. No. 1,167,190, issued to Lippincott, discloses a portable shower device in which water is heated by an electric heater. U.S. Pat. No. 1,011,113, issued to Button, discloses a shower having a reservoir divided into upper and lower compartments.

While all of the referenced prior art discloses shower devices which are, to some extent, portable or adjustable, all of said devices require that the water utilized be separately heated and then transferred into the device or, alternatively, heated by a device incorporated within the portable shower.

Accordingly, with the above cited prior art, the heat source itself, or a separate container for heating the shower water must additionally be transported, a situation not feasible in many outdoor camping or hunting situations. Additionally, the requirement of heating water in a separate container applicable to many prior devices creates potential hazard in transporting and pouring hot water from one container to another.

Further, in many hunting and camping situations, the only heat source available may be an open fire.

Accordingly, a need exists for a portable outdoor shower device capable of being filled with water, heated from a primitive heat source such as an open fire and suspended in an appropriate location for utilization, without requiring an exchange of water between different containers. Specifically, an optimal portable outdoor shower device must permit water to be heated within the device itself so as to obviate the necessity of transferring heated water from one container to another.

An optimal portable outdoor shower device must permit the water to be heated from a primitive heat source, such as an open fire or campfire, without damage to the device.

In many instances, the need for use of a portable outdoor shower device arises in situations where a separate or internal heat source is impractical, where transporting an additional container for heating water separately would create an undue hardship and where the only satisfactory heat source is primitive in nature, in the way of a campfire or other open fire. As noted, existing portable shower devices do not satisfy the above requirements.

SUMMARY OF THE INVENTION

This invention is directed to provision of a portable outdoor shower device which will permit utilization in remote areas not dependant on self-contained heat sources, or upon the necessity of separately heating water in a different container to be then placed in the device.

More specifically, this invention is directed to the provision of a portable outdoor shower device that is especially designed to be filled with water and heated, and utilized as a shower device, without the necessity of transfer of heated water. A more specific object is to provide a portable outdoor shower device not dependant upon an internal heat source.

An additional specific object of the invention is to provide a portable outdoor shower device which may be heated directly from a primitive heat source such as an open fire or campfire.

According to an important feature of the invention, the device consists primarily of a container for liquid comprised of an inflammable material, such as metal, which may be heated in direct contact with fire.

According to a further feature of the invention, the primary container has a generally flat, horizontally disposed underside, which permits the device to stand upright while being heated, whether placed above a fire on a grid or grill, on the ground directly adjacent to a fire, or within the fire itself.

According to a further feature of the invention, fluid flow, allowing water to pass from the invention into and through a showerhead is provided by a hollow cylinder horizontally aligned with the bottom of the container and extending through the vertical wall of the container. In order to provide as uniform a temperature as possible in the water flowing through the showerhead, the hollow cylinder portion of the within the container extends to a point approximately central to the bottom area of the container. This placement prevents initial delivery of water that is either too hot or too cold, which might be occasioned otherwise when the device is heated by setting it at the edge of a fire or other heat source where the heat is applied directly to only a portion of the container.

According to a further feature of the invention, flow of water from the container through the showerhead is regulated by a fluid flow control valve which is affixed to the hollow cylinder on the exterior of the primary container. This fluid control valve is placed in a shut position when the device is being heated and, after heating, while being suspended, and is opened by the person utilizing it, at the time desired.

According to a further feature of the invention, the primary container is fitted with a cover which is further secured by a cross member extending across the diameter of the primary container and holding the cover firmly against the primary container. The advantages of such a cover include allowing the water contained in the container to be heated more rapidly, and the prevention of spills when the container is being removed from the heat source and suspended, and during shower operations.

According to a further feature of the invention, the cover of the container has an aperture, through which a thermometer is inserted into the container in order to monitor the temperature of the water being heated for future shower use. The thermometer is of a type which allows it to be read externally of the container, while in monitoring position, and a further feature of the invention allows the thermometer to either be kept permanently in place during all operations, or to be removed and inserted only for monitoring purposes as may be, from time to time, desired.

According to a further feature of the invention, a means of suspending the invention is provided through an eye-bolt or "padeye" mounted on a cross member attached over the top of the primary container having a duel purpose of holding the cover to the primary container in place. The eye-bolt or padeye is positioned so that its opening is in a vertical plane permitting simple insertion of a rod, stick, hook, rope or other device for use in placing the device on the heat source, removing it therefrom, and suspending the device from a point vertically above the position of the shower recipient.

The above and additional features of the invention may be considered and will become apparent in conjunction with the drawings in particular, and the detailed description which follow.

DETAILED DESCRIPTION OF THE PREFERRED EMBODIMENT

Figure 1:
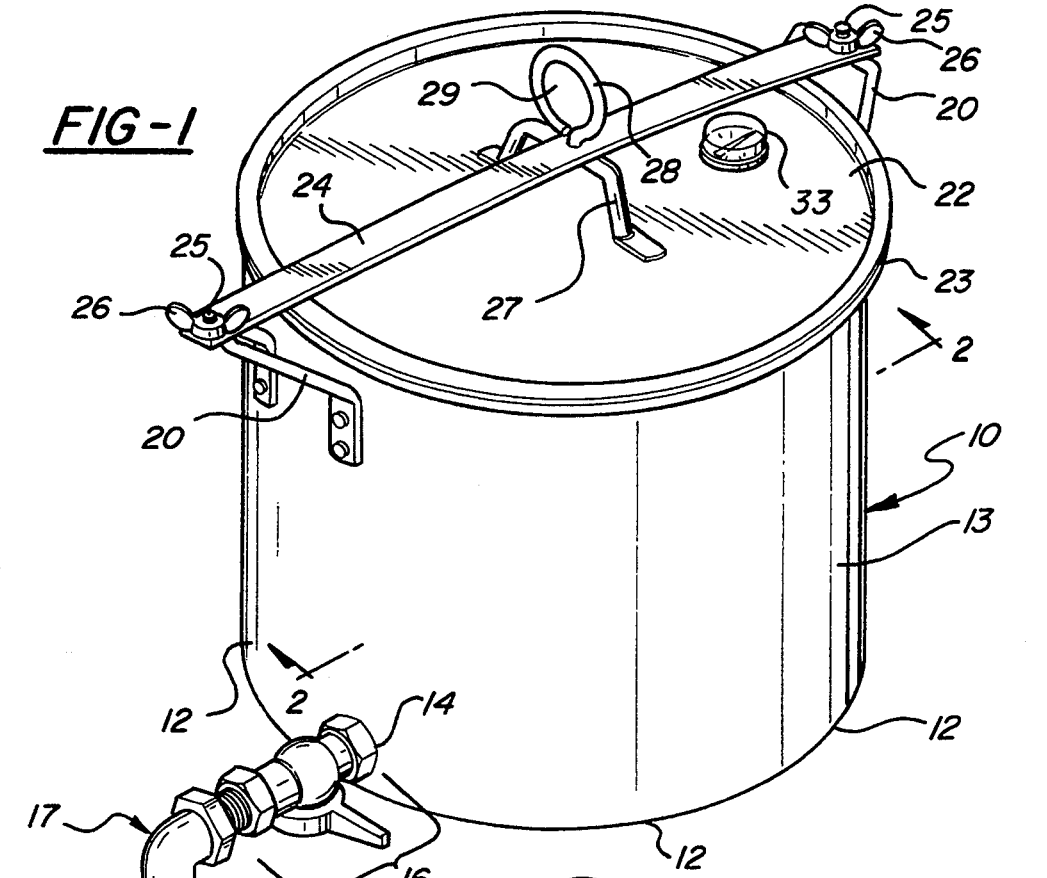
FIG. 1 is a side elevational view of the portable outdoor shower device with the cover, securing, cross member, and thermometer in place, and the fluid flow valve in the closed or shut position.
Figure 2:
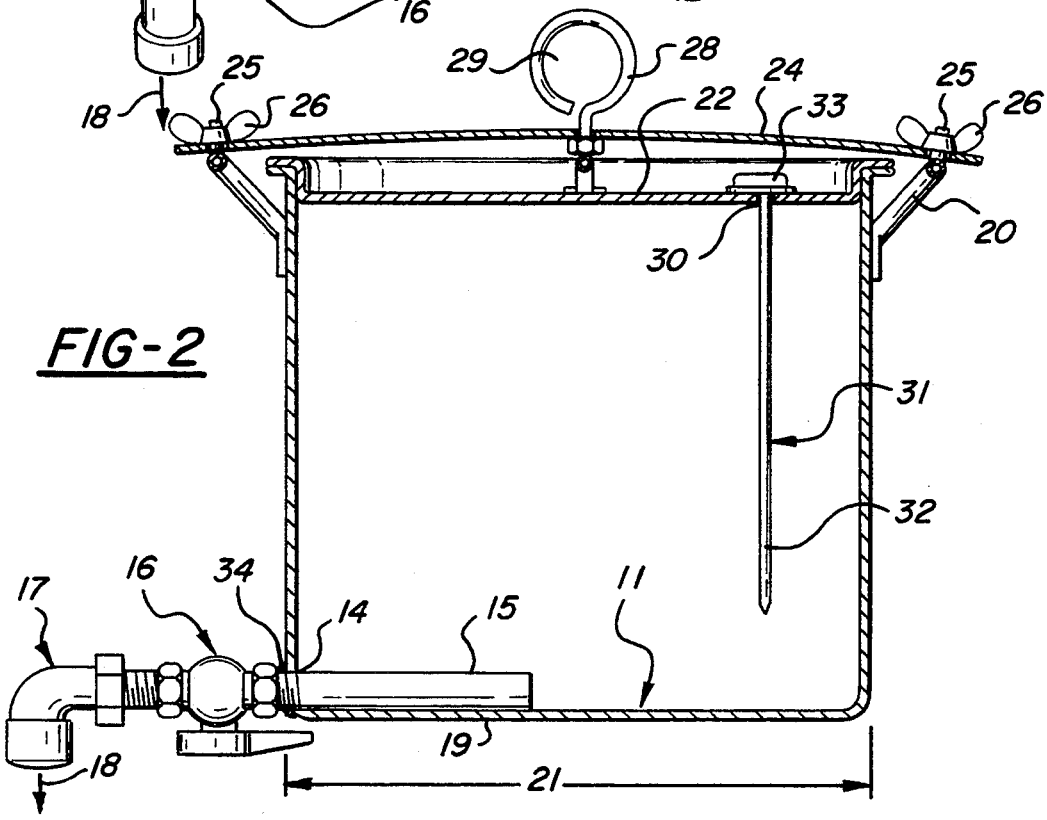
FIG. 2 is a cross sectional view of the invention taken along line 2—2 in FIG. 1 and showing the fluid flow control valve in the open position.
Figure 3:
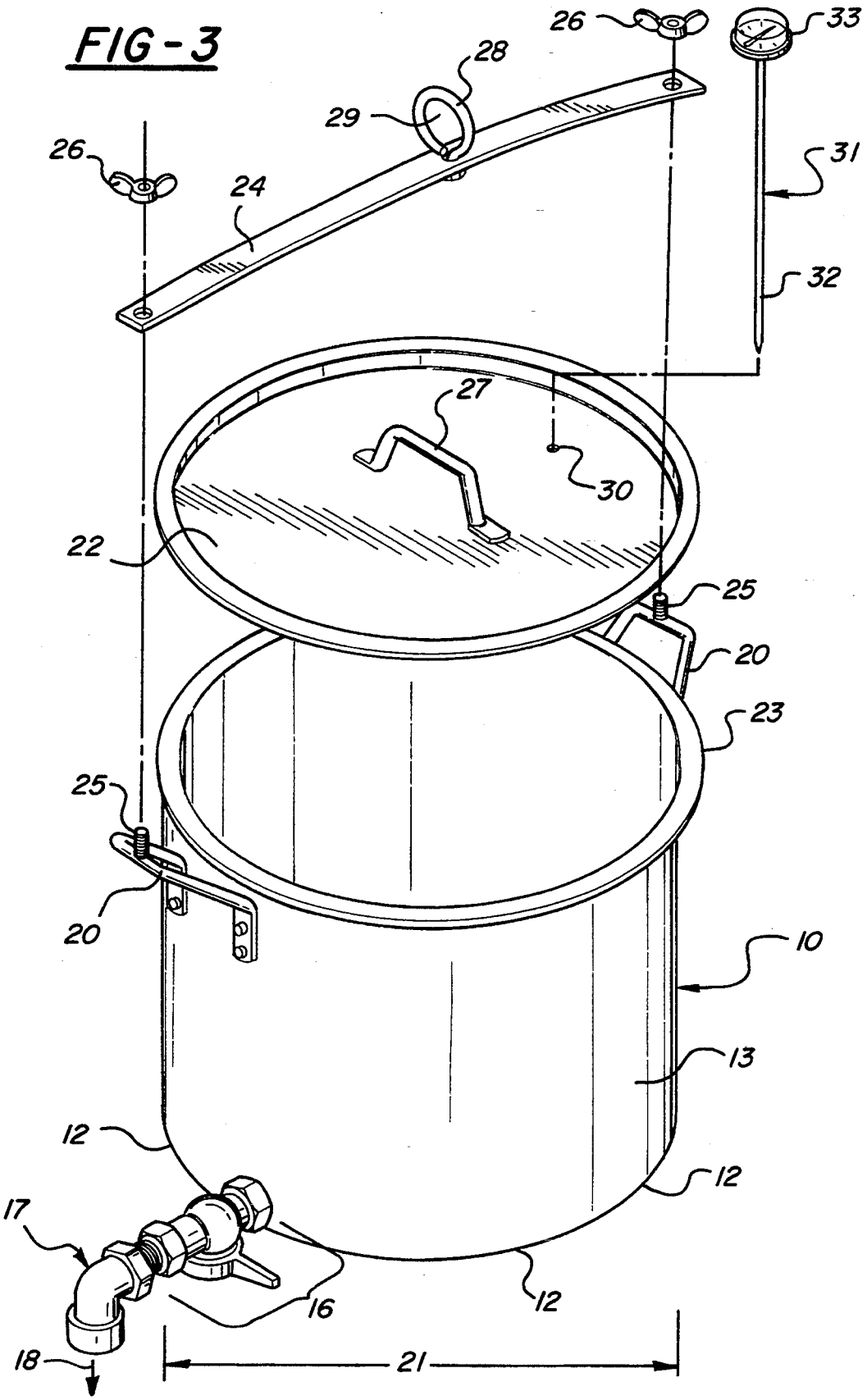
FIG. 3 is a partially exploded side perspective view of the invention showing the relationship of the primary container, cover, cross member, and thermometer, and showing the fluid flow control valve in the closed or shut position.

The invention portable outdoor shower device, broadly considered, includes a unitary basin container 10 for holding a liquid. The container 10 further comprises a horizontal base surface having a defined exterior boundary 12 and a unitary wall surface 13 extending vertically upward from said defined exterior boundary 12, about the circumference of said exterior boundary 12.

The unitary wall surface 13, further defines an aperture 14 located directly adjacent to the base surface 11.

A hollow cylindrical member 15 sufficient to allow fluid flow extends horizontally from the interior of the container 10 through the aperture 14. The exterior dimension of the cylindrical member 15 further defines the interior dimension of the aperture 14. A fluid flow control valve 16 having a closed position which prevents fluid flow through the cylindrical member 15 and the showerhead 17, and an open position which permits said fluid flow is affixed to the cylindrical member 15 outwardly of the aperture 14. A downwardly directed 18 showerhead member 17 to diffuse the fluid flow for shower purposes is affixed to the fluid control valve 16 outwardly of the fluid control valve 16.

In the preferred embodiment of the invention, the cylindrical member 15 extends inwardly to a point 19 approximately central to the area of the base surface 11. A pair of u-shaped brackets or handles 20 are mounted on the exterior vertical surface 13 of the primary container 10. The brackets are opposedly mounted, and separated by the diameter 21 of the base surface 11. The u-portion of the brackets 20 extend outwardly and upwardly from the vertical surface 13.

In the preferred embodiment of the invention, a planar cover 22 having a defined exterior boundary 23 equal to or greater than the defined exterior boundary 12 of the horizontal base surface 11 is mounted on the primary container 10 parallel to and opposite the base surface 11. The cover 22 is held in place by a planar cross member 24 having a length greater than the distance between the outwardly and upwardly extended u-shaped brackets 20. The preferred means for affixing the cross member 24 to the u-shaped brackets 20 comprises a vertically extending threaded bolt member 25 extending upwardly from each bracket 20, passing through an aperture defined by the cross member 24 and a threaded wingnut 26 which is rotationally positioned on the bolt member 25 in a male/female relationship. The cover 22 has a handle member 27 mounted central to the surface area of said cover 22 and extending vertically upward to a point such that when said cover 22 is placed on the unitary container 10, the upward portion of the handle member 27 is in contact with the planar cross member 24 holding the planar cover 22 in place, in contact with the unitary container 10.

An eyebolt or padeye 28 is centrally affixed to the planar cross member 24 so that the opening 29 defined by said padeye is in a vertical plane permitting so as to permit insertion of a transporting or suspension device.

In a further preferred embodiment of the invention, the planar cover 22, further defines an aperture 30 and a thermometer 31, the base 32 of said thermometer 31 extending through said aperture 30 and downwardly into the unitary container 10. Said thermometer 31 further comprises a temperature indicator 33 which remains upward of the planar cover 22 and is visible above said planar cover 22.

In a further preferred embodiment of the invention, the cylindrical member 15 is permanently affixed to the interior of the aperture 14 defined by the unitary wall surface 13 by a water tight weld.

In a further preferred embodiment of the invention, all component parts of the invention are fabricated from metal.

In a further preferred embodiment of the invention, the exterior of the hollow cylindrical member 15 and the interior of the aperture 14 are threaded 34 so that the cylindrical member 15 is extended through the aperture 14 by rotating said cylinder member 14 in a male/-female relationship to the aperture 14. Said fluid flow control valve 16 has two threaded interior cylindrical surfaces and the downwardly directed showerhead member 17 and the hollow cylindrical member 15 each have a threaded exterior, both being affixed within said fluid flow control valve 16 in a male/female relationship.

The fluid flow control valve 16 has both an open position wherein fluid flow is permitted from the primary container 10, through the vertical member 15, the flow valve 16, and the showerhead 17, and a closed position wherein such fluid flow is prevented.

In another embodiment of the invention, a means for suspending the invention is comprised of an assembly means affixed at a plurality of points on the vertically extending unitary wall surface 13 supporting a padeye member aligned in a vertical plane above and approximately right angles to the horizontal base surface 11.

WHEREAS, a preferred embodiment of the invention has been illustrated and described in detail, it will be apparent that various changes may be made in the disclosed embodiment, without departing from the spirit of the invention.

What is claimed is:

1. A portable outdoor shower device comprising:

a. a unitary basin container for holding a liquid, further comprising a horizontal base surface having a defined exterior boundary and a unitary wall surface extending vertically upward from said defined exterior boundary about the circumference thereof, b. said unitary wall surface further defining an aperture located therein directly adjacent to said base surface, c. a hollow cylindrical member extending horizontally from the interior of said container through said aperture to permit fluid flow through said aperture, the exterior dimension of said cylindrical member further defining the interior dimension of said aperture, wherein the hollow cylindrical member extends inwardly from the vertically extending wall surface to a point approximately central to the horizontal base surface d. a fluid flow control valve to regulate fluid flow affixed to said cylindrical member outwardly of said aperture, e. a downwardly directed showerhead member to diffuse fluid flow affixed to said fluid control valve, outwardly of said fluid control valve, and f. a means for suspending said device from a fixed point.

2. A portable shower device according to claim 1, said means for suspending said device comprising an assembly means affixed at a plurality of points on the vertically extending unitary wall surface said assembly supporting a padeye member aligned in a vertical plane above and at approximately right angles to said horizontal base surface.

3. A portable outdoor shower device according to claim 1 wherein the exterior of said cylindrical member is permanently affixed to the interior of the aperture defined by the unitary wall surface by a water tight weld.

4. A portable outdoor shower device according to claim 1 wherein the exterior of the hollow cylindrical member and the interior of the aperture defined by the vertically extending wall surface are threaded so that the cylindrical member is extended through the aperture by rotating said cylindrical member in a male/-female relationship to the aperture.

5. A portable outdoor shower device according to claim 1, said fluid flow control valve having a threaded interior cylindrical surface and said downwardly directed showerhead member having an extended exteriorly threaded cylindrical member connected to said fluid control valve in a male/female relationship and said hollow cylindrical member having a threaded exterior and being affixed to said fluid flow control valve in a male/female relationship.

6. A portable shower device according to claim 1, said means for suspending said device comprising an assembly means affixed at a plurality of points beyond the vertically extending unitary wall surface said assembly supporting a padeye member aligned in a vertical plane above and at approximately right angles to said horizontal base surface.

7. A portable outdoor shower device according to claim 1, said unitary wall surface extending vertically upward defining a generally cylindrical outward shape of said unitary basin container.

8. A portable outdoor shower device according to claim 1, said device further comprising a planar cover, said cover further defining an aperture therein, and a thermometer, removably mounted through said aperture.

9. A portable outdoor shower device comprising:

a. a unitary basin container for holding a liquid, further comprising a horizontal base surface having a defined exterior boundary and a unitary wall surface extending vertically upward from said defined exterior boundary about the circumference thereof, b. said unitary wall surface further defining an aperture located therein directly adjacent to said base surface, c. a hollow cylindrical member extending horizontally from the interior of said container through said aperture, the exterior dimension of said cylindrical member further defining the interior dimension of said aperture, d. a fluid flow control valve affixed to said cylindrical member outwardly of said aperture, e. a downwardly directed showerhead member affixed to said fluid control valve, outwardly of said fluid control valve, f. a pair of u-shaped brackets opposedly mounted on the exterior of the vertically extending surface, said brackets being separated by the diameter of said base surface and extending outwardly and upwardly from said vertically extending surface;

g. a planar cover having a defined exterior boundary greater than the defined exterior boundary of said horizontal base surface;

h. a planar cross member, having a length greater than the distance between the outwardly and upwardly extended u-shaped brackets;

i. means for affixing said cross member horizontally to said u-shaped brackets;

j. a handle member mounted centrally on said cover, extending vertically to a point so that when said cover is placed on said unitary container that the handle member is in contact with said planar cross member;

k. a means for suspending said device from a fixed point.

10. A portable outdoor shower device according to claim 1, said means for affixing said cross member horizontally to said u-shaped brackets comprising a vertical externally threaded member extending from each bracket and an interiorly threaded wingnut rotatingly placed on each threaded member in a male/female relationship and said cross member further defining apertures proximately located in relation to each threaded member, with the threaded member passing through the aperture.

11. A portable outdoor shower device according to claim 9, said cover further defining an aperture, and a thermometer mounted through said aperture, said thermometer further comprising a temperature indicator visible above said planar cover.

12. A portable outdoor shower device according to claim 9 wherein the hollow cylindrical member extends inwardly from the vertically extending wall surface to a point approximately central to the horizontal base surface.

13. A portable outdoor shower device according to claim 9 wherein the exterior of said cylindrical member is permanently affixed to the interior of the aperture defined by the unitary wall surface by a water tight weld.

14. A portable outdoor shower device according to claim 9 wherein the exterior of the hollow cylindrical member and the interior of the aperture defined by the vertically extending wall surface are threaded so that the cylindrical member is extended through the aperture by rotating said cylindrical member in a male/-female relationship to the aperture.

15. A portable outdoor shower device according to claim 9, said fluid flow control valve having two threaded interior cylindrical surfaces and said downwardly directed showerhead member having an extended exteriorly threaded cylindrical member connected to said fluid control valve in a male/female relationship and said hollow cylindrical member having a threaded exterior and being affixed to said fluid flow control valve in a male/female relationship.

16. A portable outdoor shower device according to claim 1, said unitary wall surface extending vertically upward defining a generally cylindrical outward shape of said unitary basin container.

* * * * *